US008265468B2

(12) United States Patent
Carr, Sr.

(10) Patent No.: US 8,265,468 B2
(45) Date of Patent: Sep. 11, 2012

(54) INLINE DOWNHOLE HEATER AND METHODS OF USE

(76) Inventor: Michael Ray Carr, Sr., Minden, LA (US)

( * ) Notice: Subject to any disclaimer, the term of this patent is extended or adjusted under 35 U.S.C. 154(b) by 710 days.

(21) Appl. No.: 12/399,193

(22) Filed: Mar. 6, 2009

(65) Prior Publication Data

US 2009/0166032 A1 Jul. 2, 2009

Related U.S. Application Data

(63) Continuation-in-part of application No. 11/899,137, filed on Sep. 4, 2007, now Pat. No. 7,509,036, which is a continuation-in-part of application No. 10/886,526, filed on Jul. 7, 2004, now abandoned.

(51) Int. Cl.
*F24H 1/10* (2006.01)

(52) U.S. Cl. ..... 392/478; 166/60; 166/61; 392/465

(58) Field of Classification Search ..... 392/478, 392/465, 301, 304
See application file for complete search history.

(56) References Cited

U.S. PATENT DOCUMENTS

| | | | | |
|---|---|---|---|---|
| 2,268,978 | A * | 1/1942 | White | 299/6 |
| 2,525,314 | A * | 10/1950 | Rial | 166/60 |
| 2,808,110 | A * | 10/1957 | Spitz | 166/61 |
| 2,893,490 | A * | 7/1959 | Williams et al. | 166/60 |
| 4,472,113 | A * | 9/1984 | Rogen | 417/321 |
| 5,400,430 | A * | 3/1995 | Nenniger | 392/305 |
| 5,509,474 | A * | 4/1996 | Cooke, Jr. | 166/64 |
| 5,907,107 | A * | 5/1999 | Welker | 73/863.11 |
| 6,115,541 | A * | 9/2000 | Rhodes | 392/441 |
| 2002/0176704 | A1 * | 11/2002 | Roe | 392/393 |

* cited by examiner

*Primary Examiner* — Thor Campbell
(74) *Attorney, Agent, or Firm* — David B. Dickinson

(57) ABSTRACT

A well bore fluid is heated to prevent paraffin build-up or lower the viscosity of asphaltenic crude in the production line by an electrical heating element lowered into a pre-determined subterranean location. The heating element is controlled by a control unit that is connected to a temperature sensor and a pressure sensor, which detects temperature and pressure in the vicinity of the heating element and modifies an electric power source to deliver sufficient electric power to the electric heating element to keep the paraffin or other alkanes in a liquefied state. By modifications, the same heater can be used to generate steam in a well bore for the same purposes or to heat oil in a tank battery to prevent solidification of high molecular weight constituents in the crude.

2 Claims, 8 Drawing Sheets

INLINE DOWNHOLE HEATER AND METHODS OF USE

CROSS REFERENCE TO RELATED APPLICATIONS

This application is a continuation-in-part of my application, Ser. No. 11/899,137, which is a continuation in part of Ser. No. 10/886,526 filed on Jul. 7, 2004 and entitled "Inline Oilfield or Pipeline Fitting Element," which is based on my provisional application Ser. No. 60/397,723 filed on Jul. 22, 2002, the full disclosures and priority of which are hereby claimed. This application also claims the priority of application Ser. No. 10/614,580 filed on Jul. 7, 2003 (now abandoned) to which my prior applications claimed priority.

BACKGROUND OF THE INVENTION

This invention relates to an apparatus and method for heating a fluid, which has poor flowability or troublesome rheology due to the buildup of paraffin or asphaltenes on the walls of the tubing or in the well bore. More particularly, the present invention relates to an apparatus and method of improving flowability of subterranean formation fluid by using an inline heating method.

One of the problems associated with oil production is the deposition of paraffin or asphaltene on the walls of production tubing or the well bore. The oil is pumped to the surface or forced to the surface from a relatively hot area through a cool zone where the temperature of the formation is less that the solidification temperature of paraffin or asphaltene. Once paraffin or asphaltene separate from the crude oil fluid flow, they tend to adhere to the production line walls causing a restriction in the tubing. Over time, these high molecular weight hydrocarbons build up on the walls of the production tubing and significantly affect the production flow. As the crude oil is pumped to the surface, the gas from the reservoir also rises to the surface. Reservoir gas tends to decrease the reservoir pressure and increase the time the crude oil is flowing through the production tubing. As a consequence, the reduced flow of oil loses speed and pressure as it travels from downhole to the surface. The decreased temperature increases the viscosity of the oil and further reduces the flow rate.

This phenomenon is well known in the field and various methods have been employed to solve the problem. One such method is the so-called "Hot Oil Treatment." According to the hot oil treatment method, steam is pumped under significant pressure into the area between the casing and the tubing. The pressure applied during this process forces paraffin residue into the production formation. This method is ineffective as interaction of steam pressure in the producing zone frequently results in clogged perforations and ultimately the decline or loss of production. The pressure steam method is also time consuming, and requires down time to complete, is expensive and presents significant risks to the operator.

Another method that is conventionally used in the oil industry to treat paraffin deposits requires stopping the production, retrieval of the tubing, cleaning by scraping or steam-cleaning the inner wall of the well string to remove the paraffin and asphaltene deposits and then replacing the tubing back into the well. This method is also time consuming and costly and does not prevent future paraffin deposits in the pipes. The method is merely a maintenance procedure that works for a short period of time. Additionally, the risk of loss of production while the well is shut-in, coupled with the maintenance expense, makes many wells unprofitable to produce if such method is used.

Still another commonly employed method is a chemical treatment using solvents that are introduced in the well bore in an effort to dissolve or liquify the heavy alkanes, including paraffin and asphaltenes, and improve the flow of crude oil. Long-term injection of chemicals is expensive.

All these methods and systems have minimal success in addressing the problem as it occurs. The conventional tools are single units with limited heating capabilities that cannot be extended or scaled up to cover a greater zone of treatment. Furthermore, the electrical heating devices used in conventional downhole heaters tend to allow hydrocarbon leakage at electrical connections or at wire feed-through areas, which can cause failure of the insulation around the conductors and fire or explosion in the volatile environment downhole.

One of the more serious problems is the failure of the conventional tools to detect and monitor downhole temperatures at the vicinity of the heater and thereby regulate the temperature in the critical areas to provide long-term economical thermal treatment in the well.

An embodiment of the present invention eliminates the need to install, heat the formation and then remove the heater assembly of existing heater technology. Instead, an inline downhole open-annulus heater is deployed for long-term service that can be controlled and regulated from the surface as it heats the oil before it is passed through the production tubing and moved to the surface. As other well production hardware is removed from the well for service or replacement, the embodiment of the present invention may be removed and checked for continued serviceability in the well. This open annulus heater system can also be employed to generate steam for enhanced oil recovery by deploying the heater with a pass-through packer which, upon installation creates a limited longitudinal zone for steam soaking or injection.

Water pumped into the annulus triggers a valve on the packer to open dumping water on the heater, which is rapidly vaporized into steam increasing the pressure and thereby closing a check valve to hold the steam and other fluids in the confined zone desired. As the steam is absorbed or reaches thermal equilibrium with the formation, the existing pressure from the water above the packer opens the valve again and the process repeats over and over as long as desired in cyclic fashion, thereby stimulating production from the desired zone or permitting the lower viscosity oil to be easily moved to the surface by the down hole pump system, which may either be a rod pump system or an electrical submersible pump system.

SUMMARY OF THE INVENTION

It is, therefore, an object of the present invention to provide an inline heating apparatus that can be positioned and fixed as part of production tubing in the well bore for heating the fluid as it passes from the hot temperature zone to the cold temperature zone.

It is another object of the present invention to provide a method of heating production fluid by positioning the heating apparatus as part of the well string in the locations where the paraffin is likely to solidify.

It is a further object of the present invention to provide an apparatus and method for heating fluid that can incorporate a number of heating assemblies or stacking of the modular heating assemblies for improved heating capacity.

These and other objects of the present invention are achieved through a provision of an apparatus for heating a fluid flow to treat a well bore and retain paraffin and asphaltene in a liquefied state while traveling through a production tubing, or line.

A fluid heater comprises an elongated hollow body having a longitudinal passage therethrough, said hollow body connected to a tube adapted for positioning said hollow body to function as a heater at a desired location in a fluid; a plurality of heater elements carried on an exterior surface of said hollow body to contact the fluid; an electrical conductor having a proximal end at an electrical power supply source and having a distal end terminated in an sealed space in said hollow body where such electrical conductor is connected to each of the plurality of heater elements; and, a control circuit for sensing and generating a signal responsive to measured conditions adjacent the plurality of heater elements thereby permitting the control circuit to sense conditions adjacent the heater elements and modify the electrical power supply to said heater elements. The temperature sensor and a pressure sensor can be both connected to said control circuit. The control circuit can be adapted to use at least two temperature sensors, a first temperature sensor mounted adjacent the elongated hollow body and a second temperature sensor mounted at a surface location to increase the heat provided at the production zone if the temperature of the produced fluid falls too near the solidification temperature range of the paraffinic or asphaltenic crude oil.

Additionally, a steam-generating heater system can be fashioned using a pass-through packer connected between an upper portion of the tube on which the fluid heater is connected and the heater assembly, providing a seal between an interior wall of a well bore casing and through which a valve can be selectively operated to permit fluid to enter from the annular space between the well bore casing and the tubing into the annular space immediately adjacent the fluid heater to release of such fluid forming a flash of steam within the well bore. The fluid heater-steam generator can further provide a check valve positioned on an opposed side of the pass-through packer to prevent steam from passing back through such packer.

These heater systems can be adapted to provide other useful functions in the oil and gas industry. For example, a method of maintaining a crude oil stream from a producing zone to a surface at a temperature selected to remain above the melting temperature of high molecular weight alkanes can be accomplished by inserting a resistive heater in a cool zone of a production string electrically connected to a first temperature sensor adjacent said resistive heater and a second temperature sensor at the surface; and, heating the crude oil in said cool zone to a temperature greater than the melting temperature of the high molecular weight alkane in the crude oil to a temperature sufficient to permit the free flowing crude oil to reach the surface while retaining a temperature above such melting temperature. The sensing of the temperature at both the production zone and the surface permits the specific flow rate and the power of the heater system to be adjusted to safely and economically make the well more productive.

A second method of generating steam within a well bore can be accomplished with a slight variation of the principle open annulus heater previously described by inserting a open annulus heater into a zone of interest, said open annulus heater having a pass-through packer sealing the annulus of the well bore and providing a valve responsive to pressure on a proximal side of such packer and a check valve to prevent escape of steam or fluid on a distal side of said packer; closing a surface valve on a production line communicating through said packer; pumping water into the annulus to provide a source for the generation of steam by the heater; pressuring up on the water from a pump at a surface location to open said valve admitting water to the energized heater elements creating steam in the well bore below the packer to heat the zone of interest; and, opening the surface valve on the production line to permit flow of produced fluids from the zone of interest.

This method of generating steam within a well bore can be extended to hold pressure on the surface pump thereby permitting cyclic saturation of the zone with steam by opening of the valve to permit additional water to enter the heater chamber to form steam and permit soaking of the zone of interest.

Finally, the closed jacket inline heater of the original patent application can be adapted to be used as a method for maintaining flow in a crude oil storage tank by connecting an inlet to a closed jacket inline heater assembly to a tank outlet port; connecting a circulating pump to the outlet of said closed jacket inline heater; connecting the circulating pump to the inlet of the storage tank; energizing the pump and inline heater to continuously flow oil through the outlet to the heater and back to the tank to maintain a constant temperature of all the oil in the tank above the melting point of the heavy alkanes in said tank.

BRIEF DESCRIPTION OF THE DRAWINGS

Reference will now be made to the drawings, wherein like parts are designated by like numerals, and wherein.

DETAILED DESCRIPTION OF SEVERAL EMBODIMENTS

Figure 1:
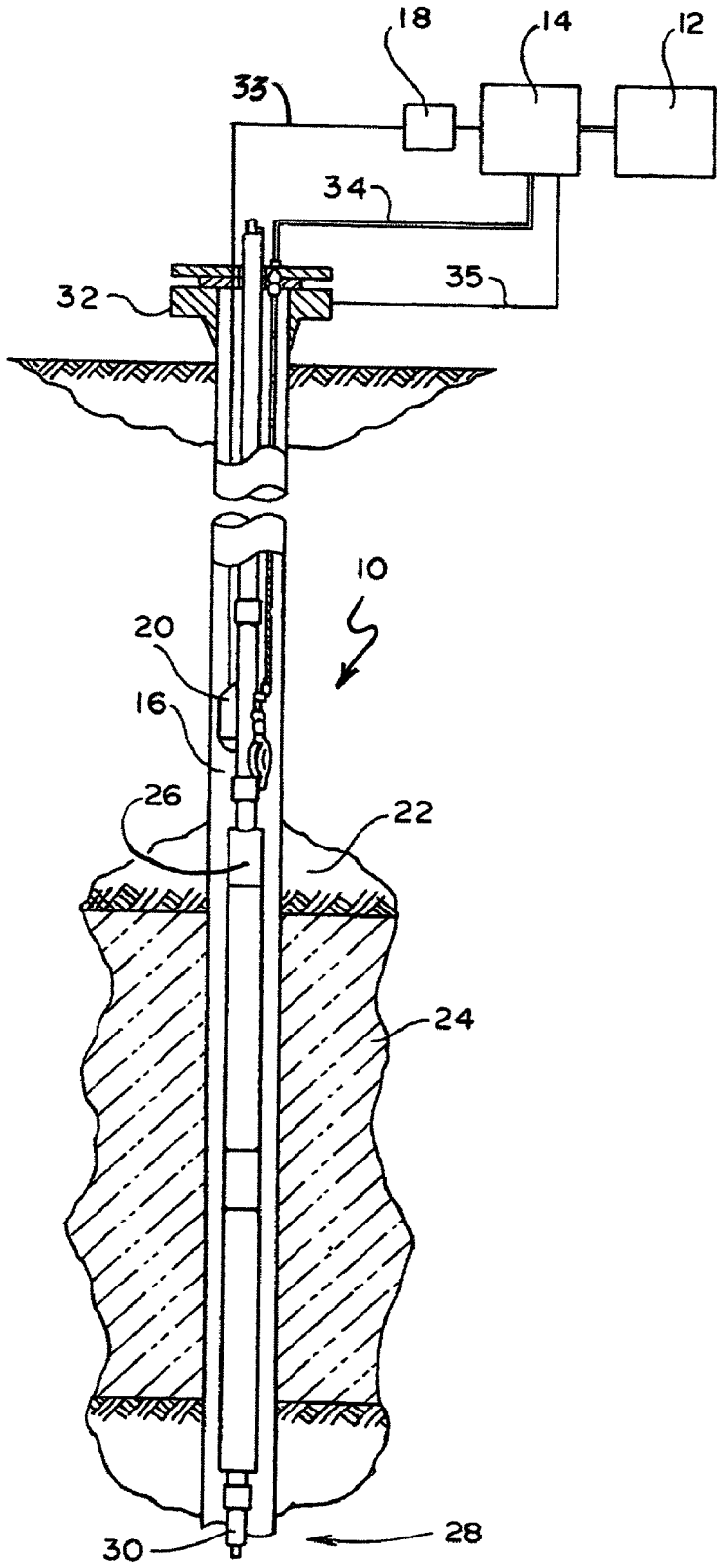
FIG. 1 is schematic view illustrating position of the apparatus in accordance with the enclosed annulus embodiment of the present invention in a well bore.

Turning now to the drawings in more detail, numeral 10 designates the inline heating apparatus in accordance with the present invention. As represented in FIG. 1, the apparatus 10 is operationally connected to a buck/boost transformer 12, a temperature controller 18, and an electrical supply control panel 14 positioned at the surface. The transformer 12 is adapted for connecting to a source of electrical power, for instance a 480-watt power source, permitting adjustment of the voltage up or down as required to provide the optimum electromotive force to overcome the resistance of the deployed system and the cabling. While the voltage required to drive the heater can be planned for in the installation process, the need to move the heater assembly up or down in the well bore can add additional resistance which must be overcome to permit the heater assembly to perform optimally. The electrical supply control panel 14 transmits electrical power to the heating elements positioned in the well 16 formed in the ground formation. The power generator 14 receives a signal from a temperature controller 18 that is operationally connected to a temperature sensor 20 through cable 33 which can be run into the well in a manner well known to those in this art.

The apparatus 10 is positioned in a selected pre-determined location in the "cool zone" 22 of the well 16 wherein paraffin solidification is likely to occur. A hot zone 24 is usually located below the cool zone 22 and thus, it will generally not be necessary to position the apparatus 10 in the zone 24. As can be seen in FIG. 1, the apparatus 10 can be connected end-to-end with a well bore string 26 which extends in the well bore 16 toward a production zone 28.

Extending through the central opening in the apparatus 10 and through the well bore string 26 is a production line, or production tubing 30, through which crude oil is pumped from the production zone 28 to the surface. The transformer 12, the power source 14, and the temperature controller 18 are positioned on the surface above a wellhead 32 and the conductors for both the power and control functions are inserted through a well head penetrator (not shown) mounted on well head 32, all in a manner well known in the industry.

Figure 2A:
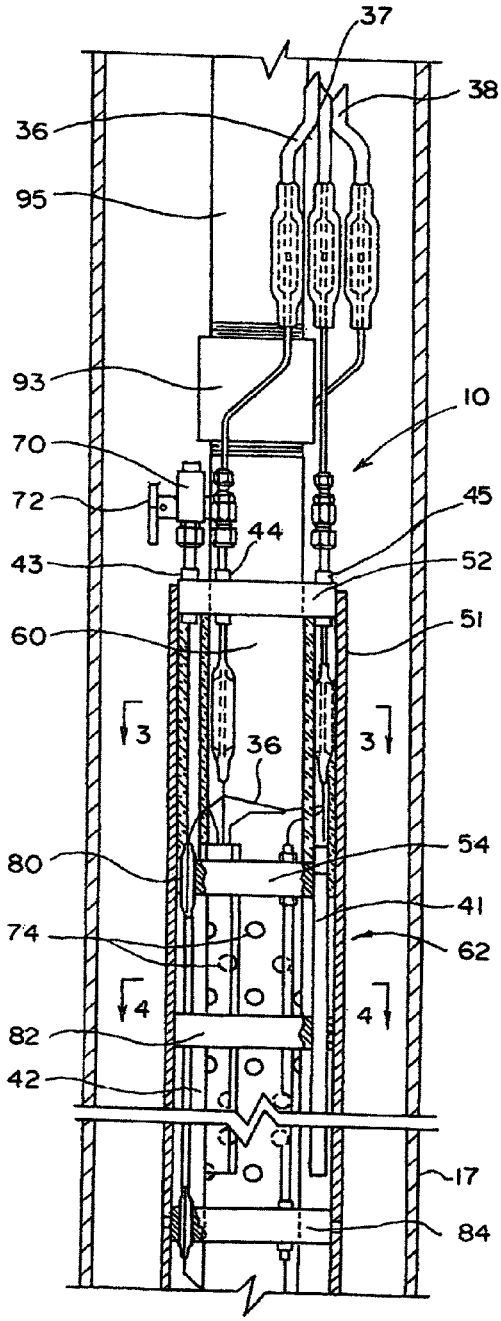
FIG. 2A and FIG. 2B illustrate portions of the apparatus of the enclosed annulus embodiment of the present invention, with the interrupt lines introduced to fit the page size.
Figure 2B:
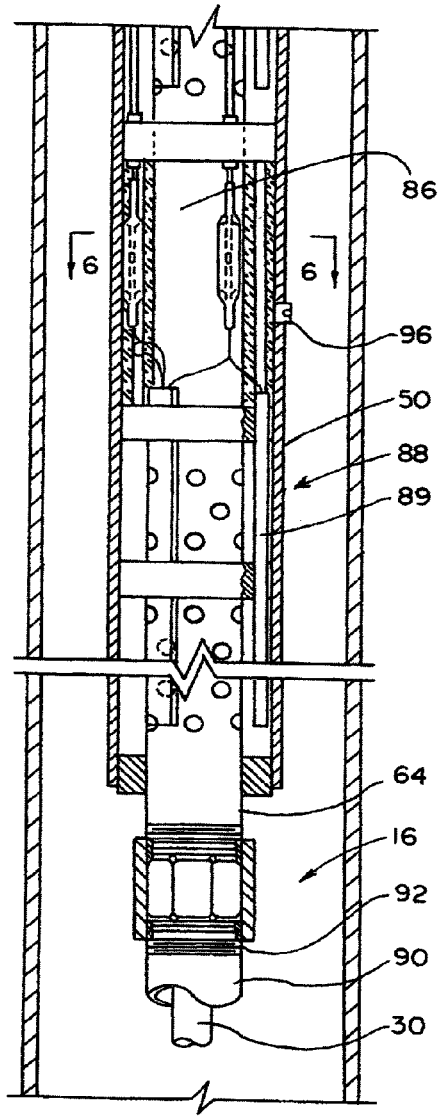

The apparatus 10 has distinct portions that for the ease of explanation are designated as "dry zone" and "wet zone." As can be seen in FIGS. 2A and 2B in conjunction with FIG. 1, three wires or conductors 36, 37, and 38 are carried in a standard armored electrical cable 34 into the well 16 from the an electrical supply control panel 14. Another cable 35 is a ground wire, and yet another cable 33 extends from the temperature controller 18 to the temperature sensor 20.

Each of the wires 36, 37, and 38 is connected to a respective heating element 40 (not visible in this view but visible in FIGS. 3 and 4 in cross-section), 41 and 42. Each of the heating elements comprises an elongated heating member extending longitudinally in the elongated hollow body 50 of the apparatus 10. The body 50 comprises a top plate 52 sealed against the interior of the hollow body 50 that carries the connecting wires 36, 37 and 38 that extend through the plate 52 into the interior of the hollow body 50. The wires 36, 37 and 38 can be Kapton-coated wires sealed with graphite seals 44 and 45 in the outer surface of plate 52 crimped around the wires to prevent fluids from entering a dry zone 60 of the body 50. The plate 52 defines one end of a dry zone 60, while another transverse plate 54 defines another end of the dry zone 60. An opposite surface of the plate 54 defines one end of a wet zone 62, while still another transverse plate 84 separates the wet zone 62 from the next dry zone 86.

Figure 4:
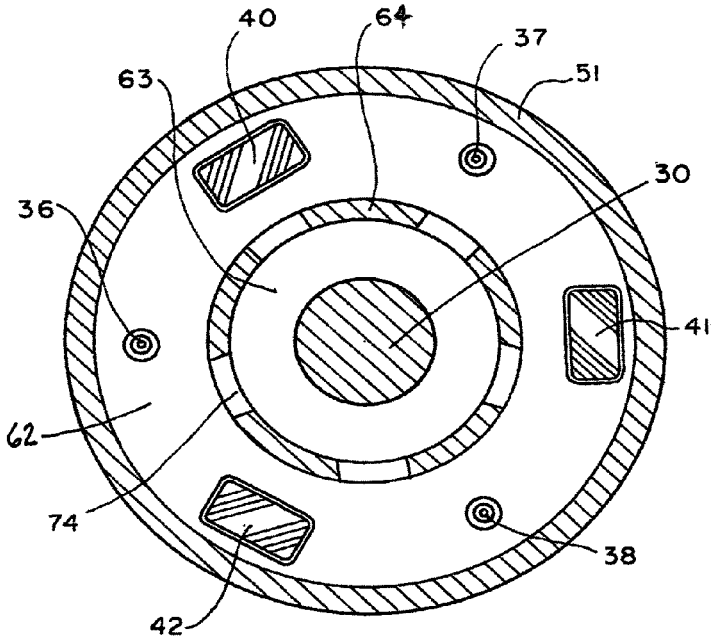
FIG. 4 is a cross-sectional view of the enclosed annulus embodiment of the apparatus of the present invention taken along lines 4-4 in FIG. 2A.
Figure 5:
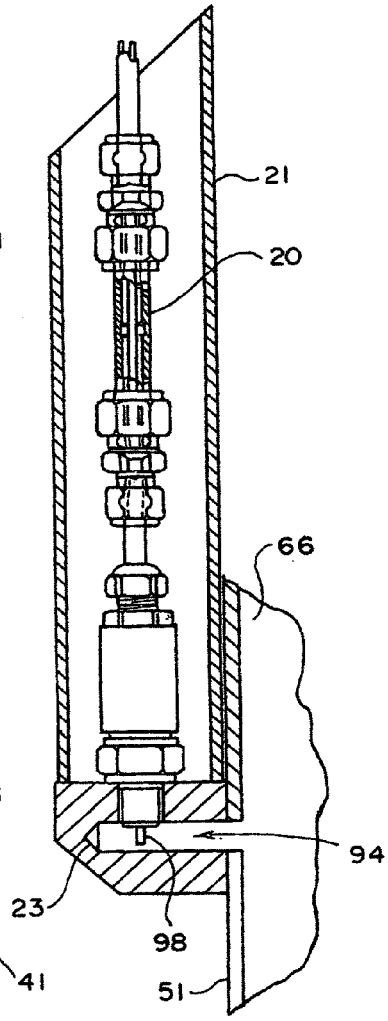
FIG. 5 is a detail, partially cross-sectional view of the temperature sensor device used in the apparatus of the enclosed annulus embodiment of the present invention.
Figure 3:
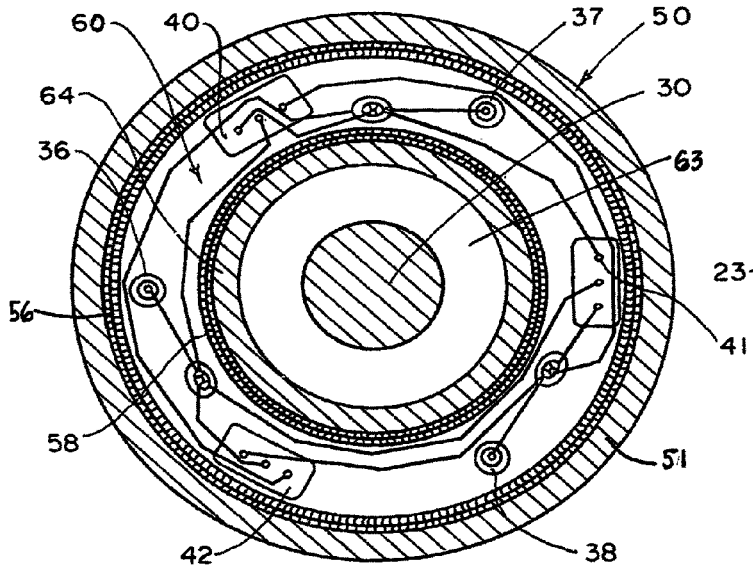
FIG. 3 is a cross-sectional view taken along lines 3-3 in FIG. 2A.
Figure 8:
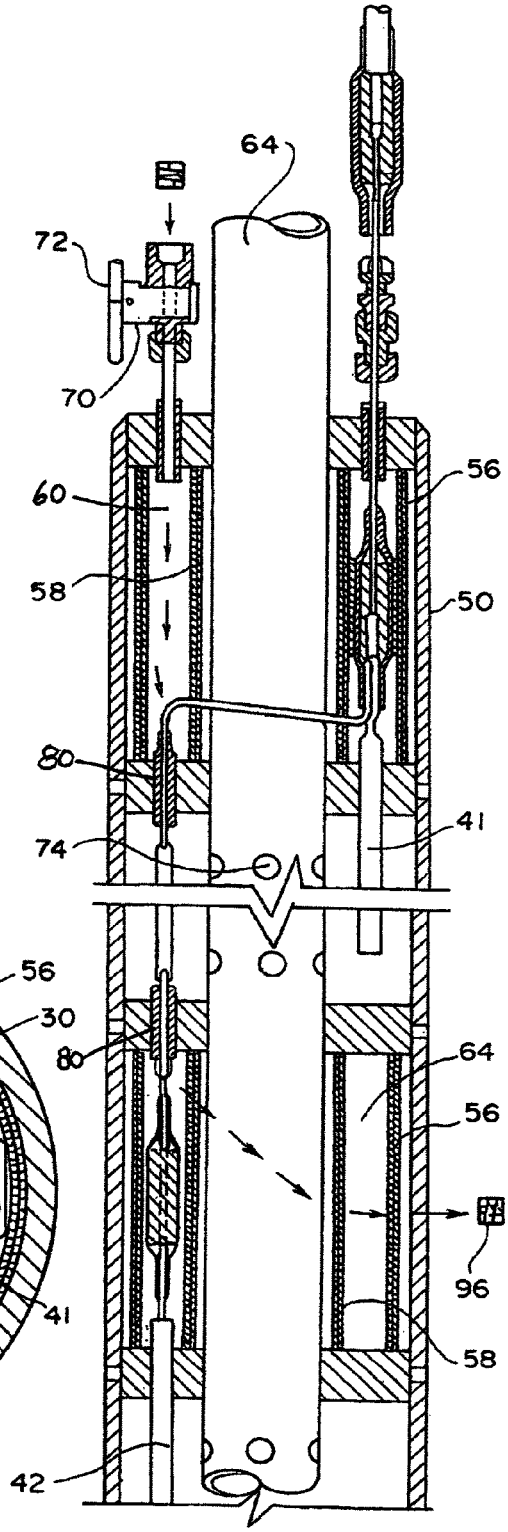
FIG. 8 is detail view illustrating purging of oxygen from the interior of the apparatus of the enclosed annulus embodiment of the present invention.

As more clearly shown in FIGS. 3 and 4, the body 50 comprises an outer housing 51 and an inner housing 64; the housings 51 and 64 are spaced apart, generally defining an annular space 66. A first insulation layer 56 is located inwardly from the outer housing 51, and a second insulation layer 58 is located on the outside of the inner housing 64. The operating wiring and the connectors extending through the dry zone 60 are thereby protected from the heat generated in the well bore and from the heat generated by the heating elements of the apparatus 10. A bushing 70 is mounted on the plate 52 in fluid communication with the annular space 60. A valve 72 is connected to the bushing 70 to allow introduction of an inert gas into the annular spaces 60 and 86, thereby causing the purge of oxygen from the space 60 as shown by arrows in FIG. 8. The inert gas—for instance, nitrogen—suppresses flash ignition in the electrical connection environment in the dry zone 60.

The wires 36, 37 and 38 extend from the dry zone 60 to the wet zone 62 by passing through a plurality of sleeves 80 positioned in the annulus 66 and subsequently through the entire apparatus 10 between the dry zones and the wet zones. Of course, the apparatus 10 can have more than one dry zone and more than one wet zone; the number of the zones and the number of heating elements will depend on the conditions of the well so that the heating elements are positioned in strategic locations for introducing a heating power to the crude oil.

If desired, a guide plate 82 can be positioned in the dry zone 62 for retaining the heating elements 41, 42 and 43 in alignment in relation to the central axis of the well casing 17 and the body 50. Another wet zone 88 can be formed next to the dry zone 86 and the tool 10 can be thus extended for providing several heating or wet zones in the well bore 16. The wet zone 88 has separate heating elements 89 that extend through the wet zone 88. Each wet zone has independent heating elements.

The inner housing 64 extends longitudinally through the entire length of the tool 10 and in a parallel relationship to the outer housing 51. The inner housing 64 is sized and configured to allow connection to production string extension of the production tubing 95, 90 (shown in FIGS. 2A and 2B) through a central opening 63 formed in the inner housing 64 of FIGS. 3 and 4.

Figure 7:
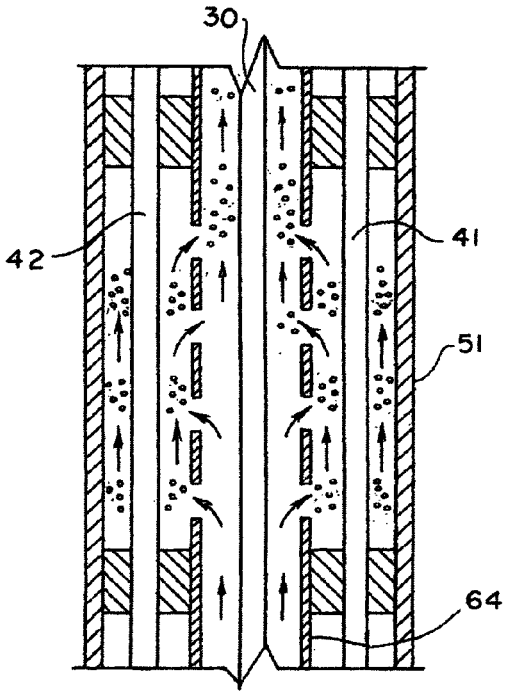
FIG. 7 is a schematic view illustrating the circulation flow in a wet zone of the apparatus of the enclosed annulus embodiment of the present invention.
Figure 6:
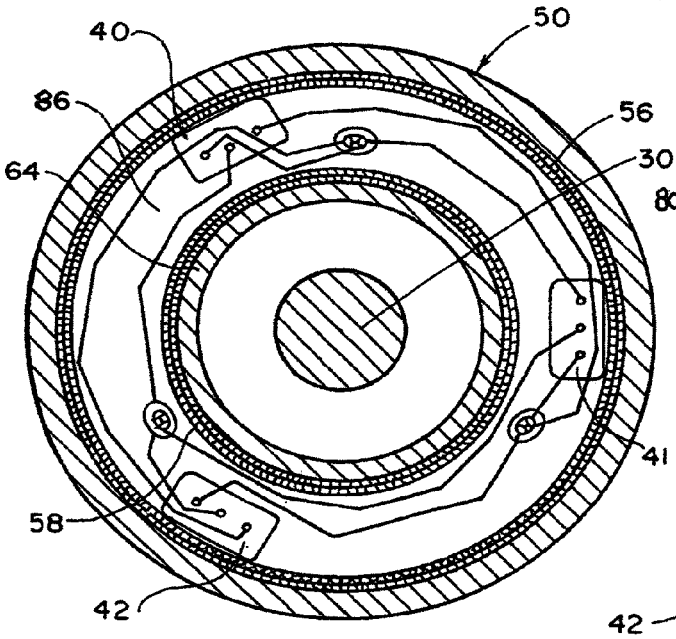
FIG. 6 is a cross-sectional view of the apparatus of the enclosed annulus embodiment of the present invention taken along lines 6-6 in FIG. 2B.

The inner housing 64 extends both through the dry zone 60 and the wet zone 62. The portion of the inner housing 64 located in the wet zone 62 is provided with perforations 74 made through the wall of the inner housing 64. The perforations 74 allow heat exchange between the well bore liquid, such as salt water and the like, entering annulus 66 from the central opening 63 in the wet zone 62. The flow of fluids in the wet zones of the body 50 is schematically illustrated in FIG. 7.

The heating elements 40, 41 and 42 extend in the wet zone 62, heat the liquid circulating through the perforations 74, and transfer the heat to the flow of crude oil passing through the production tubing 30. As a result, high molecular weight alkanes, such as paraffin or asphaltenes, suspended in the crude oil flow do not cool to a temperature low enough to cause those contaminants to be separated, solidify and attach to the wall of the production line 30.

The top of the body 50 can be connected by a suitable coupling 93 to a well string sub 95, while distal end of inner housing 64 can be attached to a free end 90 of the body 50 with a threaded connector 92 that allows the apparatus 10 to be connected to another sub (not shown) that forms a part of a well string.

The temperature sensor 20 detects the temperature in the area near the heating elements and sends a signal to the controller 18 at the surface. The sensor 20 is positioned within a temperature sensor housing 21, which is secured to the outer housing 51. The temperature sensor 20 is fittingly engaged in a receiver 23 that is secured at one end of the sensor housing 21. An opening 94 in the outer housing 51 admits fluid having a pertinent temperature from the body 50 to the end 98 of the sensor 20 thereby allowing the sensor 20 to generate a signal of the fluid temperature communicated to the controller 18. The controller 18 determines whether the temperature is above or below a preset temperature necessary to maintain paraffins or asphaltenes in a viscous state as a three-phase electric supply control panel 14 provides an electrical current to the heating elements 40, 41, and 42. If the temperature is too high, the transformer 12 can reduce the voltage. If the temperature is too low, the transformer 12 can be activated to supply more electric power to the down hole heating elements by boosting the voltage. Additionally, a silicon controlled rectifier (SCR) circuit contained within the electrical supply control panel 14 can be adjusted to control the current flow to the heater elements thereby adjusting the temperature in the produced zone fluid.

A bleed valve 96 (FIGS. 2B and 8) is set in the casing 51. A set screw opens the valve 96 to allow bleeding of air from the dry zone and introduction of an inert gas, such as nitrogen into the dry zones. The bleed valve 96 is removable to allow purge of air by the nitrogen.

Figure 9:
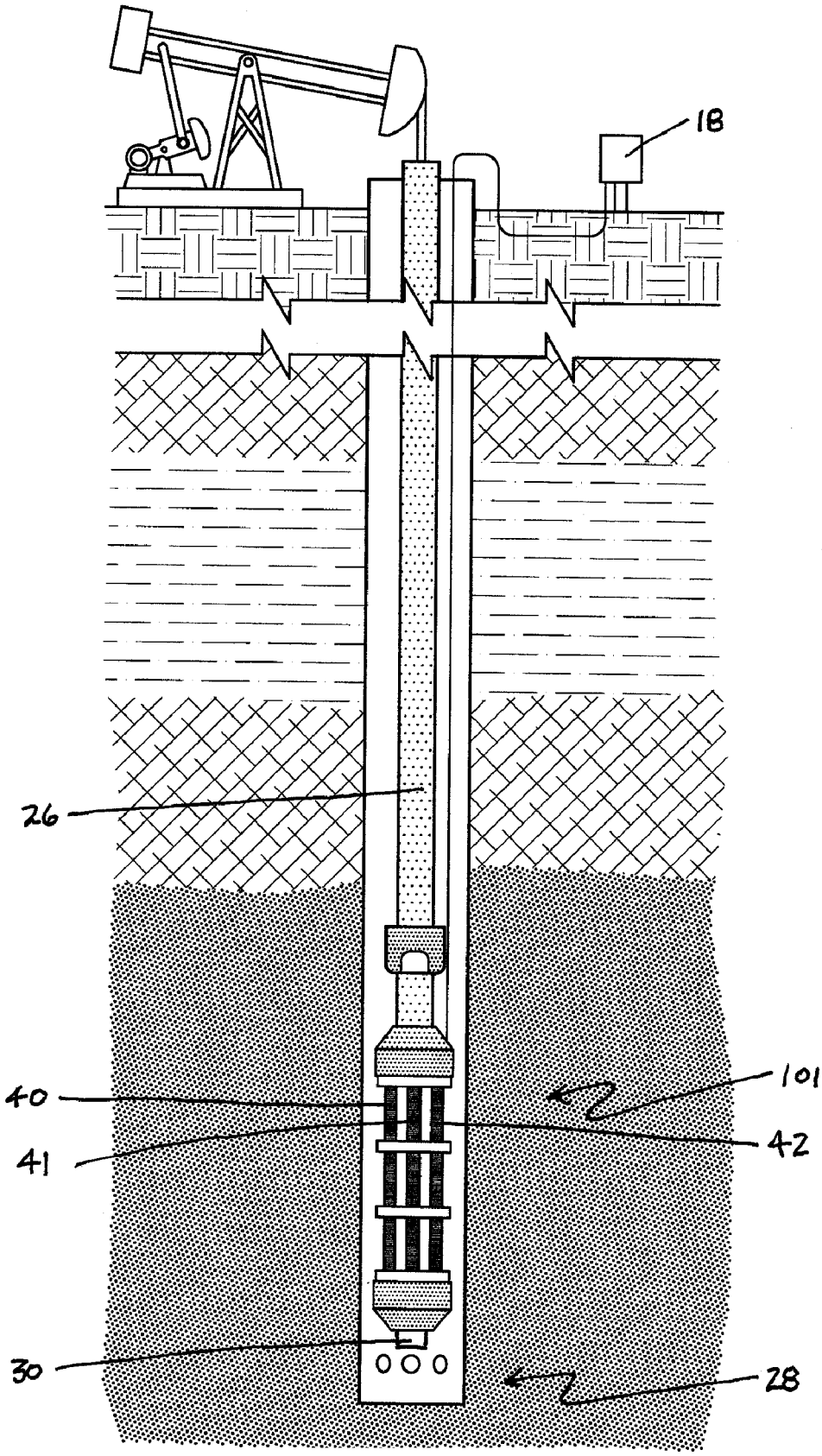
FIG. 9 is a schematic view illustrating an open-annulus embodiment of the inline heater of the present invention.

An improved annular heater system 101 as shown schematically in FIG. 9 also embodies many of the same features as shown in FIGS. 1-8. The primary difference on this new form of heater system is the wet zone outer housing 51 such as shown in FIG. 7 is removed to allow production fluid to freely move around the exposed heater elements 40, 41, 42. This direct contact permits rapid heating of the fluids in the production zone 28. Low viscosity oil is produced in the normal manner through the action of the prime mover reciprocating a sucker rod assembly 30 lifting the oil in the standard fashion well known in this art. Alternatively, the annular heater can be deployed with an electrical submersible pump (ESP) (not shown) in a standard manner and thereby permitting the ESP to lift the heated and therefore lower viscosity oil up the production tubing 26 in a standard manner.

Figure 10:
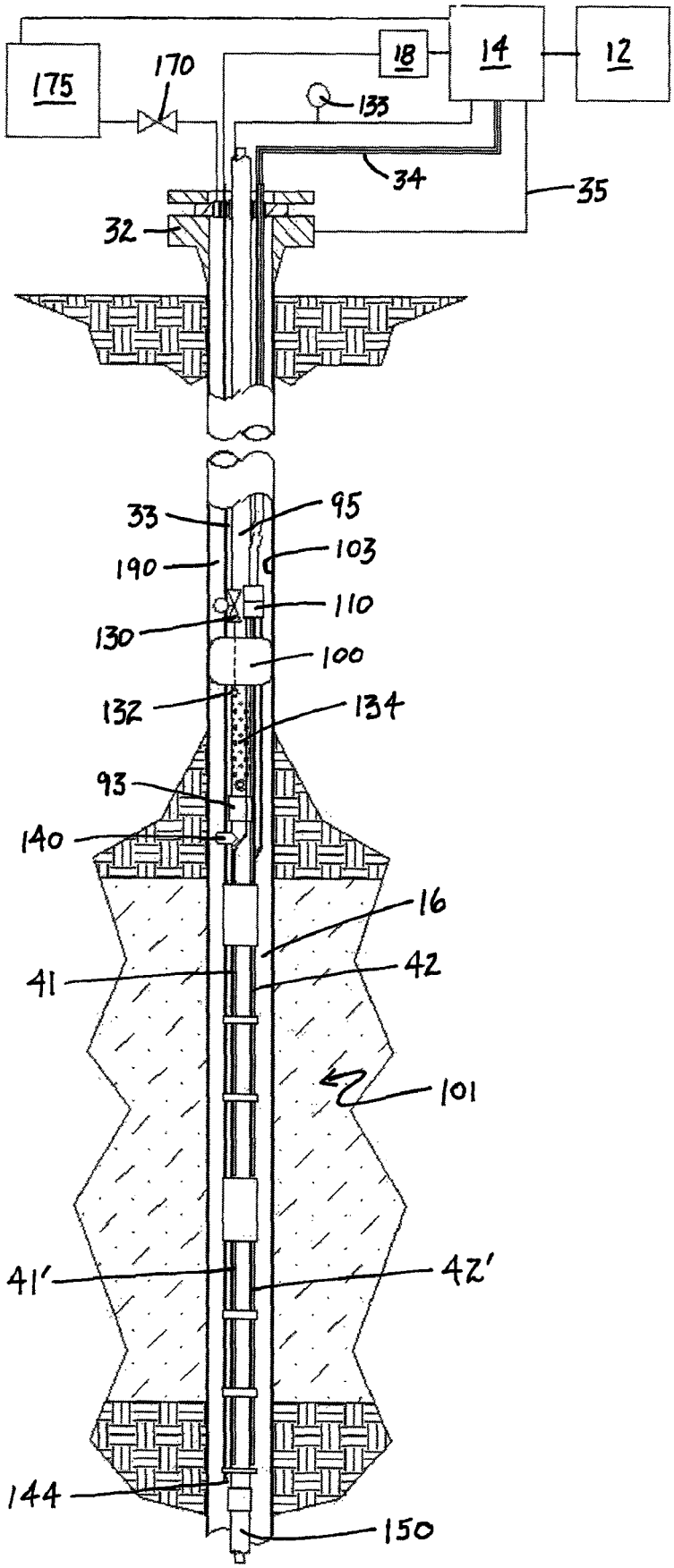
FIG. 10 is a schematic view of an injection form of the open-annulus inline heater of the present invention.
Figure 11:
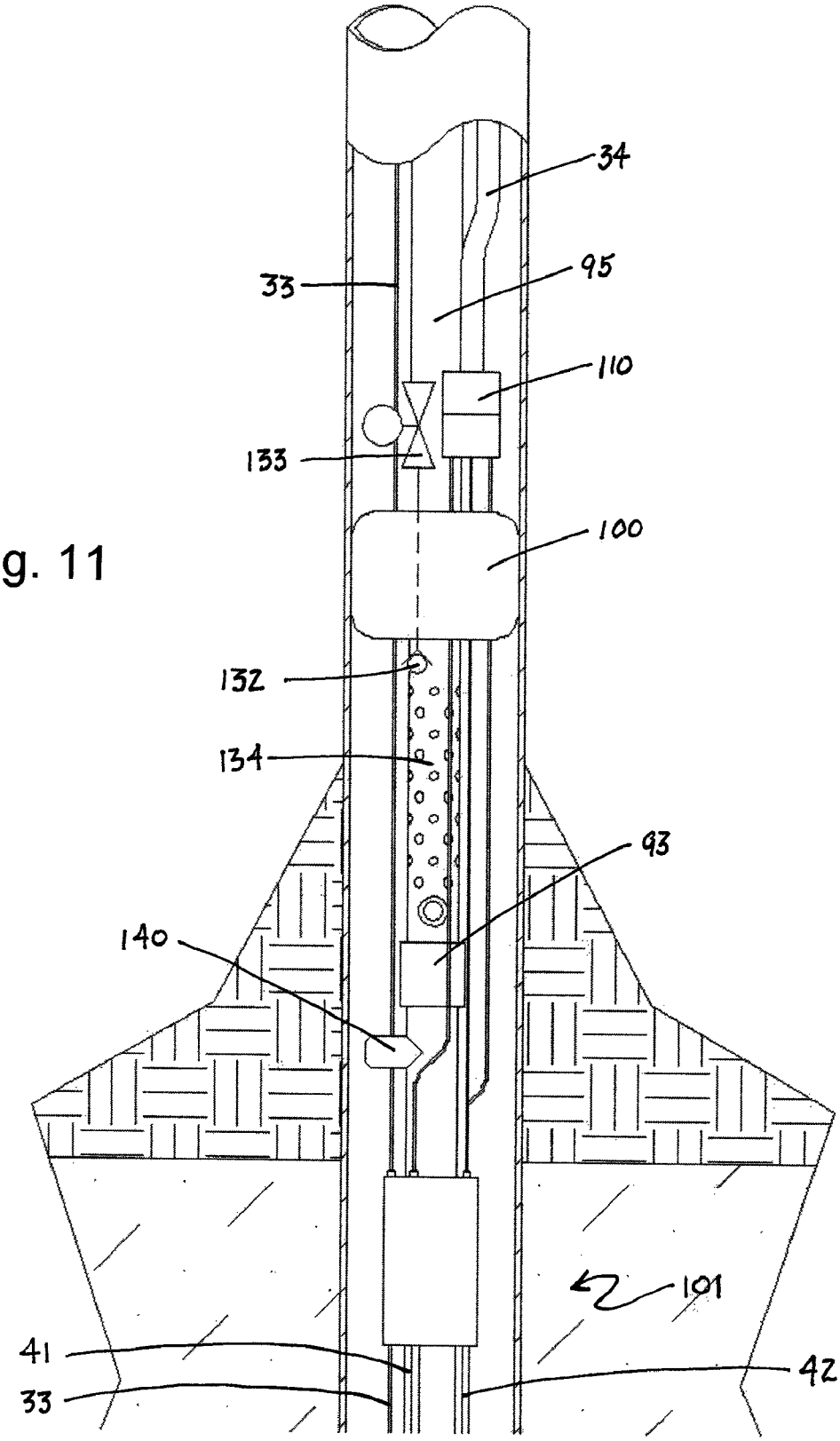
FIG. 11 is a schematic view of the details of the open-annulus inline heater.

The apparatus of the present invention can be also used for generating steam in a downhole location, which will require connection of the body 50 to a source of water. In this embodiment, a pass-through packer 100 is deployed on production tubing 95 as more fully described by reference to FIG. 10. Above this packer 100, a pressure valve 130 is installed to hold a hydrostatic load of water, which is dumped into the annulus 16 between the production tubing 95 and the interior surface of the casing tubing 103. The standard production valve (not shown) located at the wellhead 32 is closed, and a surface valve, shown schematically as 170, is opened to permit pump 175 to pump water into the annulus 190. When a appropriate amount of water is pumped into the annulus, the pump pressure can cause pressure valve to open thereby dumping the water from the annulus onto heater system 10 having each heater elements 40 (not shown), 41 and 42 exposed to this water which is rapidly vaporized and allowed to soak the formation for a set period of time. The surface valve is then opened and normal production commences with the hot oil whose viscosity has been reduced by the steam saturation received from this process through production screen 134.

This embodiment further provides a check valve 132 to prevent steam or fluid egress from the sealed production zone below the packer 100. As with the previously described embodiment, standard electrical connectors 110 mate the standard electrical supply conductors to the electrical connectors of the annulus heater system as previously described to provide electromotive force to the heater elements. Both, in the first described embodiment and this new annulus heater embodiment, the heating elements, are supplied current to provide resistive heating which, with the introduction of water, generates steam melting the paraffin or asphaltene particles in the production zone. The length of both tools 10 and 101 can be extended by adding multiple stages, dry zones followed by wet zones, followed by dry zones, to increase the overall length of the heater assembly. The number of heating assemblies will be determined by the rate of flow and diameter of the well. The multiple stage system dramatically increases the heat output variable thereby increasing the volume of fluid that can be heated.

The use of Kapton-coated wires and graphite seals crimped around the wires form a leak-proof seal around the electrical wires where they enter the dry zones 60. Of course, the use of an insulation coating in a hot temperature environment is not limited to the use of polymer Kapton, and other suitable insulation coating can be used.

The use of 480-watt 3-phase heating elements with three heating wires increases the heat output and makes both apparatus 10 and its open-annulus embodiment 110 more efficient and cost effective. Because of the electrical control over the amount and provision of electrical power to the heater elements, the buck/boost transformer 12 and the SCR controls positioned on the surface in the electrical supply control panel 14 minimize fire hazard problems normally associated with heaters placed in an hazardous location. Signal cable 33 can also be formed from a fiber optic source or probe to monitor downhole temperature and pressure to regulate operations at the surface. Moreover, given the nature of the temperature dependent success of this type of well heater system, fiber optic time-domain reflectometry could also be deployed in conjunction with this heater system to provide continual temperature profiles and control data for the well as more fully described in U.S. Pat. No. 4,823,166, dated Apr. 18, 1989 to Hartog et al.

The system of the present invention, when electrically connected elements are activated, controls electrical currents to the elements using both the SCR or the buck/boost transformer to modify the electrical supply quickly and effectively. The control system 18 minimizes thermal cycling thereby reducing repeated thermal shock to the electrical connections and heater elements increasing the useful life of the elements. Additionally, the SCR controlled system significantly reduces electrical consumption to provide a uniform heat profile while operating making both the apparatus 10 and 110 more economical.

The present invention is designed to accommodate the insertion and placement of the downhole pump through the hollow inner core of the inner casing. As a consequence, the downhole pump can pass through the body 50 during normal installation. The perforated inner housing 64 prevents "gas locking" of the downhole production pump.

A particular advantage of the present invention is that it can be used in both horizontal and vertical piping systems and is not limited only to vertical placement. The apparatus 10 is a circulation heater as opposed to a probe heater, which is conventionally used in the field. It is envisioned that once the operator identified the cold zones, the apparatus 10 can be installed with the well bore string at a point approximately 100 to 200 feet below the deepest cold zone. In the flow or fluid lines, the problem areas can be identified by conventional tests and the apparatus 10 installed within the line 50 to 100 feet before the paraffin build-up can occur. The open-annulus heater 110, on the other hand, must either be used in a fluid or to create steam as previously described and would not be as effective for heating production hydrocarbons with slow infill rates in the production zone. It is believed that steam injection could more profitably be employed to stimulate well production from such wells.

In addition to preventing paraffin problems, both the apparatus 10 and the open annulus heater 110 can be utilized in low-gravity heavy hydrocarbon recovery. If the producing zone requires heating to raise the temperature to convert the heavy hydrocarbons to light hydrocarbons, the apparatus 110 can be used as well. Rather than using a boiler system on the surface as a steam source, the apparatus 110 provides a tool to produce and deliver steam downhole directly to the producing line. In the injection well, the apparatus 110 can be installed both a steam injection device and for lifting fluids from the production zone.

The heating elements 41, 42 and 43 are single end heat-generating elements, typically fabricated from INCONEL, but other suitable materials could be substituted, all of which is well known to those selecting materials for oil field applications. Conventional heating tools utilize heating elements that must be terminated at each end (double-ended termination), which does not allow for extension of the heating element when heated. When necessary, the elongated heating elements of either of the present embodiments can be extended to 20-feet length.

The SCR power supply delivered and the voltage regulation offered by the transformer 12 through the electrical supply control panel 14 is regulated by processors receiving data from the downhole sensors 20, 140 and 144 (for apparatus 110). As previously described, this control system minimizes the thermal shock experienced by the heating elements from repetitive expanding and contracting in excess of the optimum operating environment, thereby extending the life of the elements to a significant degree.

Figure 12:
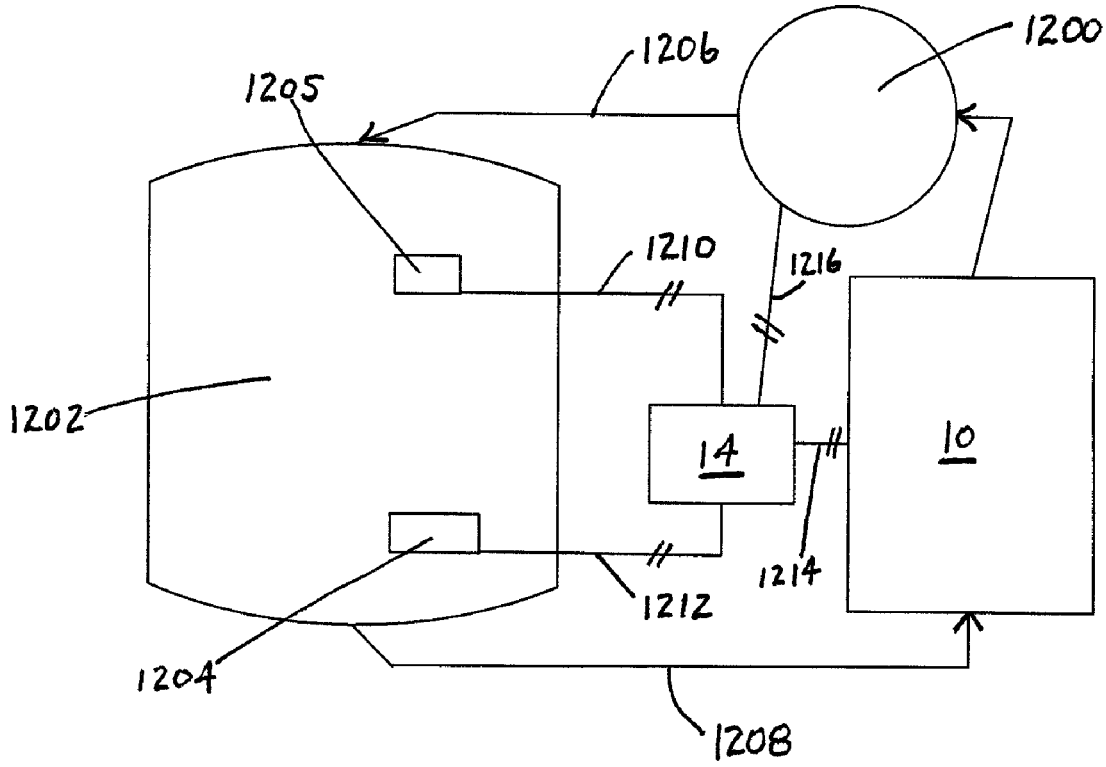
FIG. 12 is a schematic view of a tank heater embodiment of the present invention.

Finally, the heater apparatus 10 can be used to maintain high paraffinic crude in a tank battery 1202 at a temperature which prevents the dropping or solidification of the paraffin from the crude until the stock is used in refining. FIG. 12 is a schematic view of the manner in which this might be accomplished. Since the apparatus 10 can be used in either the vertical or horizontal position, the inline heater 10 could be connected to a small circulating pump 1200 to constantly remove cool oil from the tank through line 1208 and circulate it through the inline heater 10 raising its temperature to a desired temperature then allowing the now heated oil to flow back through line 1206 into the tank to continually warm the remainder and keep paraffin from solidifying in the tank. The newly heated oil would be sensed by sensor 1205 which signals through line 1210 to electrical control panel 14 (which could be adapted to perform this task in the same manner as that shown in the prior embodiments). The bottom oil temperature would be sensed by sensor 1204 which would signal the temperature to the control panel 14 through line 1212 which would increase heater power through line 1214 and modify the speed of the pump 1200 through control and power line 1216.

Many changes and modifications can be made to the apparatus and method of the present invention without departing from the spirit thereof. I therefore pray that my rights to the present invention be limited only by the scope of the appended claims.

What is claimed is:

1. A fluid heater comprising:

an elongated hollow body having a longitudinal passage therethrough, said hollow body connected to a tube adapted for positioning said hollow body to function as a heater at a desired location in a fluid;

a plurality of heater elements carried on an exterior surface of said hollow body to contact the fluid;

an electrical conductor having a proximal end at an electrical power supply source and having a distal end in an inert space in said hollow body where such electrical conductor is connected to each of the plurality of heater elements; and, a control circuit for sensing and generating a signal responsive to measured conditions adjacent the plurality of heater elements;

whereby the control circuit senses conditions adjacent the heater elements and modifies the electrical power supply to said heater elements; and, a pass-through packer connected between an upper portion of the tube on which the fluid heater is connected providing a seal between an interior wall of a well bore casing and through which a valve can be selectively operated to permit fluid to enter from the annular space between the well bore casing and the tubing into the annular space immediately adjacent the fluid heater, whereby upon release of such fluid a flash of steam is generated within the well bore.

2. The fluid heater of claim 1 further comprising a check valve positioned on an opposed side of the pass-through packer to prevent steam from passing back through such packer.

* * * * *